United States Patent [19]

Griswold

[11] 4,452,272

[45] Jun. 5, 1984

[54] CHECK VALVE

[75] Inventor: David E. Griswold, Corona Del Mar, Calif.

[73] Assignee: Griswold Controls, Irvine, Calif.

[21] Appl. No.: 236,645

[22] Filed: Feb. 23, 1981

Related U.S. Application Data

[60] Division of Ser. No. 121,156, Feb. 13, 1980, Pat. No. 4,276,897, which is a continuation of Ser. No. 918,646, Jun. 23, 1978, abandoned.

[51] Int. Cl.[3] ..... F16K 15/06

[52] U.S. Cl. ..... 137/454.6; 137/484.2; 137/543.13

[58] Field of Search ..... 137/454.6, 484.2, 543.13

[56] References Cited

U.S. PATENT DOCUMENTS

| | | | |
|---|---|---|---|
| 2,223,699 | 12/1940 | Norgren . | |
| 2,225,880 | 12/1940 | Montelius . | |
| 2,308,187 | 1/1943 | MacLean | 137/484.2 |
| 2,504,470 | 4/1950 | Trautman | 137/484.2 UX |
| 2,886,058 | 5/1959 | Horton | 137/540 X |
| 3,438,391 | 4/1969 | Yocum . | |
| 3,665,950 | 5/1972 | Nelson | 137/484.2 X |
| 3,996,962 | 12/1976 | Sutherland . | |
| 4,207,915 | 6/1980 | Becker et al. | 137/454.6 X |
| 4,244,392 | 1/1981 | Griswold et al. . | |
| 4,244,395 | 1/1981 | Griswold et al. . | |

*Primary Examiner*—Gerald A. Michalsky
*Attorney, Agent, or Firm*—Lyon & Lyon

[57] ABSTRACT

Two check valves in series with a zone between them are mounted between the supply pipe and discharge pipe, and a relief valve vents the zone to atmosphere under predetermined pressure conditions in the pipes. A valve poppet in the upstream check valve cooperates with its seat and an enclosing stationary barrel to form a first chamber. An ejector nozzle receives liquid from this first chamber when the valve poppet is open, and discharges it into the zone. The action of the ejector nozzle aspirates a second chamber in the upstream check valve to reduce the pressure drop when the valve is open. The velocity head of the discharge from the ejector nozzle is directed against a valve poppet in the downstream check valve, which also includes a pressure affected piston area. In each check valve the flow restriction across the valve seat decreases more rapidly than the downstream flow restriction. Also, the outer surface of the valve poppet in the upstream check valve defines, with its stationary barrel enclosure, a series of ribs and cavities which direct flow of fluid from the check valve through the ejector nozzle while minimizing flow into the aspirated chamber. A relief valve device connected to vent the zone to atmosphere has a valve stem subjected to a pressure differential between the inlet pressure to the upstream check valve and the reduced pressure in its aspirated chamber.

3 Claims, 6 Drawing Figures

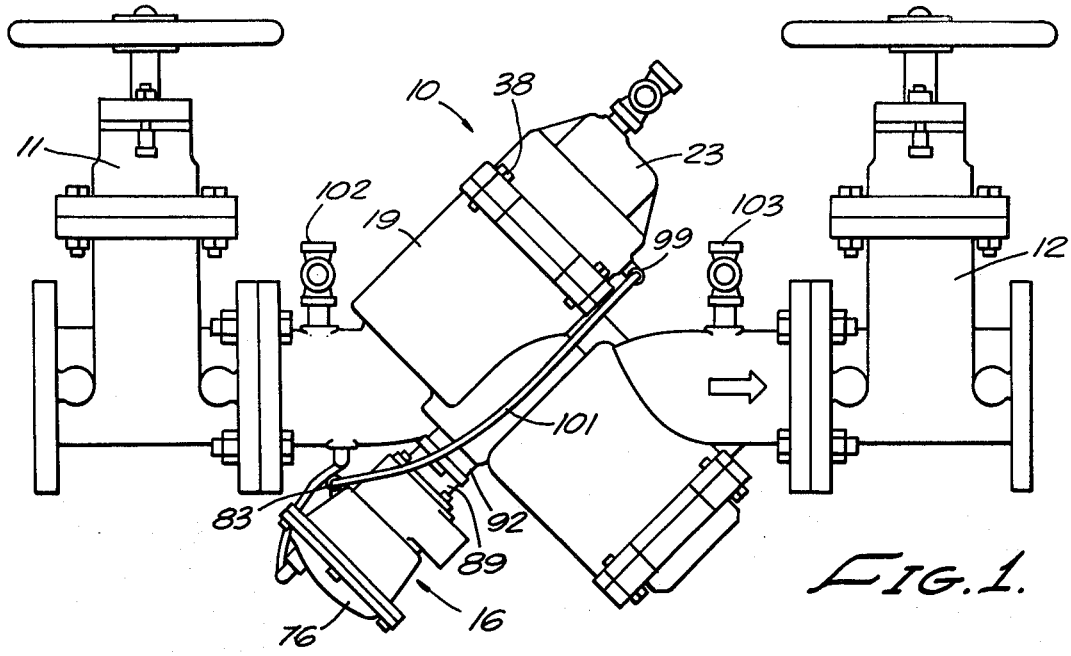
FIG. 1.
FIG. 5.
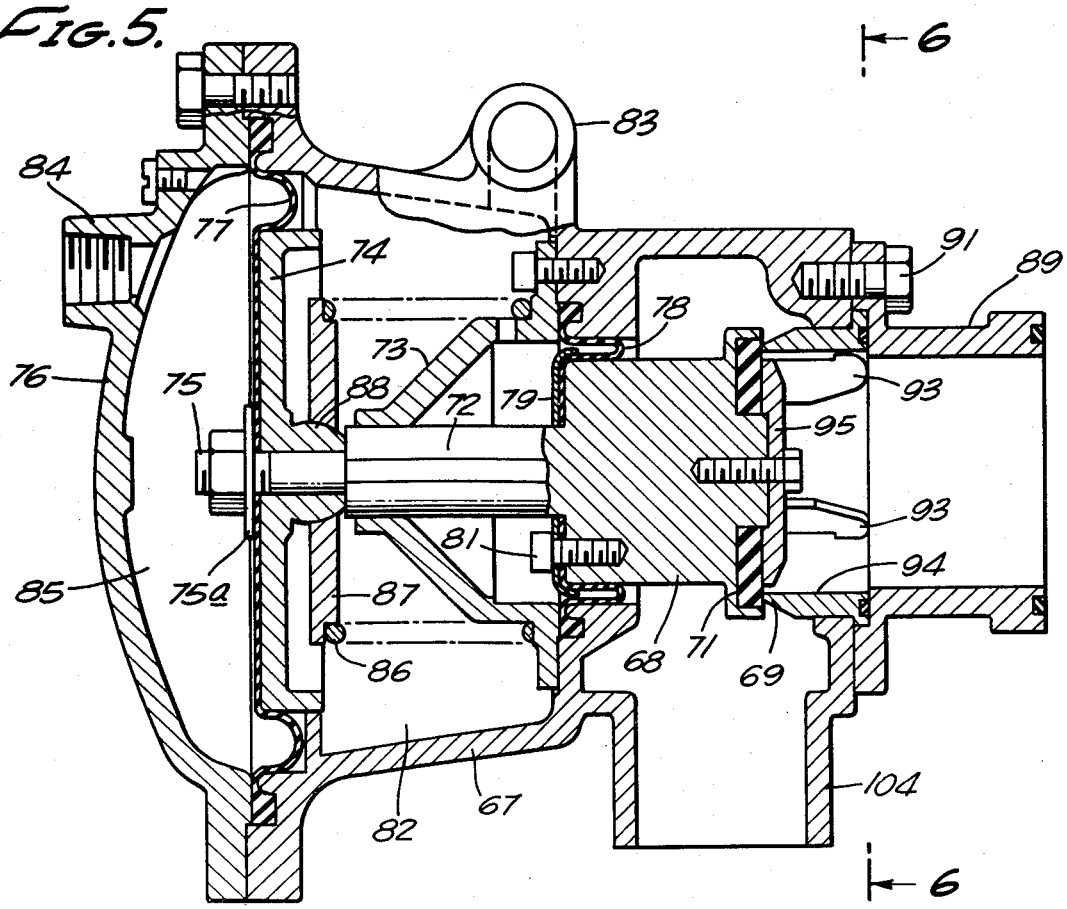

FIG. 2.
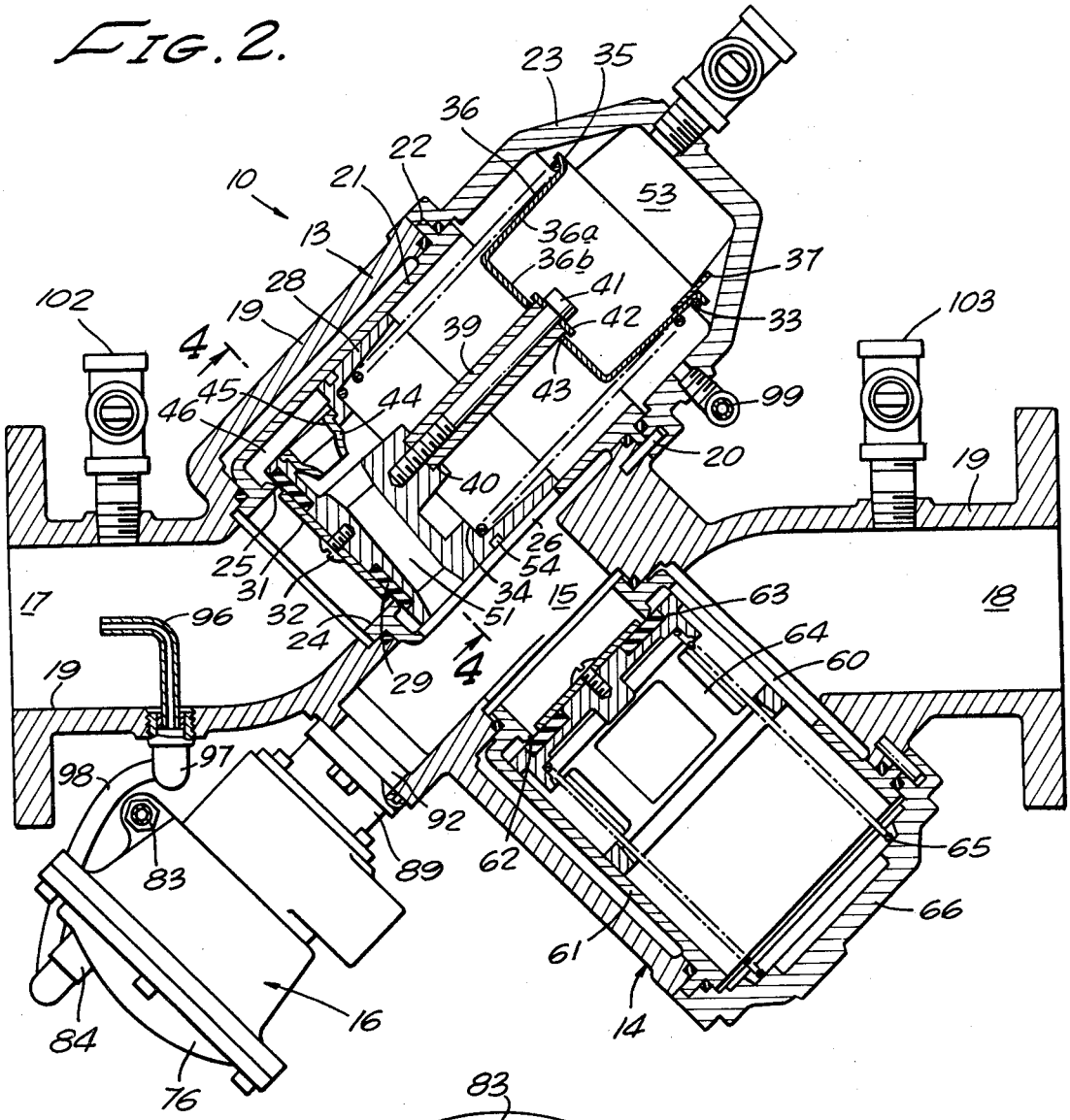
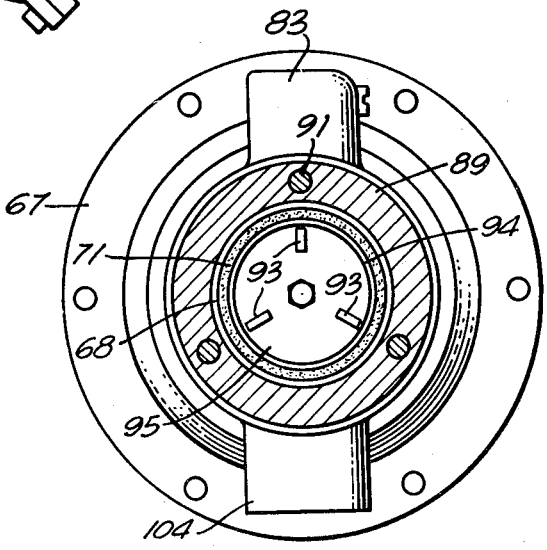
FIG. 6.

FIG. 4.
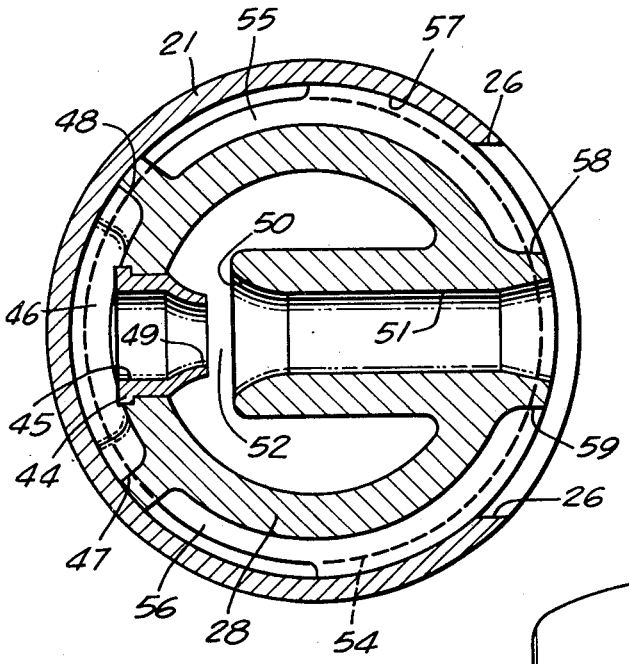
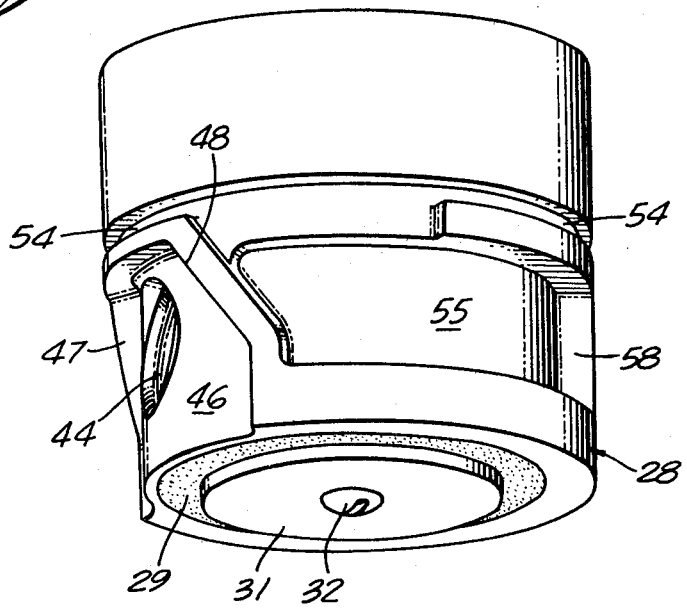
FIG. 3.

CHECK VALVE

This is a division of application Ser. No. 121,156 filed Feb. 13, 1980, now U.S. Pat. No. 4,276,897, which was a continuation of application Ser. No. 918,646 filed June 23, 1978, now abandoned.

This invention relates to backflow prevention apparatus to be installed between a supply pipe and a discharge pipe. Such devices are commonly used in water supply systems in order to insure that polluted water in a discharge pipe cannot flow in a reverse direction into a supply pipe. Such apparatus commonly employs an upstream check valve and a downstream check valve with a zone between them, along with a relief valve operated by differential pressure for venting the zone to atmosphere whenever the discharge pressure approaches the supply pressure within predetermined limits.

In accordance with this invention, the intensity of pressure in the supply pipe must be reasonably high in order to begin opening movement of the upstream check valve against the action of a load spring. Once the opening movement has begun, a larger area is presented to the upstream pressure with the result that the check valve opens to a greater degree. Flow through the upstream check valve passes through a first chamber and through an ejector nozzle which increases the flow velocity, while reducing its pressure. The discharge from the small end of the ejector nozzle passes through a space which communicates with a second chamber within the check valve assembly which is separated from the incoming flow by sliding contact of the valve poppet within a stationary barrel. The aspirating effect of the high velocity flow reduces the pressure in the second chamber so that the effective force of the load spring is reduced. The result is that very low pressure drop takes place through the upstream check valve when it is open. The ejector nozzle discharges into a third chamber which constitutes the zone between the check valves.

Another feature of the invention resides in the fact that the relief valve assembly for venting the zone to atmosphere operates on differential pressure between inlet pressure in the supply pipe and reduced pressure in the aspirated second chamber in the upstream check valve assembly. In addition, the velocity head is added to the inlet pressure in the supply pipe.

Other and more detailed objects and advantages will appear hereinafter.

In the drawings:

FIG. 1 is a side elevation showing a preferred embodiment of this invention.

FIG. 2 is a sectional elevation showing a portion of FIG. 1.

FIG. 3 is a perspective view showing the valve poppet employed in the upstream check valve assembly.

FIG. 4 is a transverse sectional view of the valve poppet shown in FIG, 3, taken substantially on the lines 4—4 as shown in FIG. 2.

FIG. 5 is a sectional elevation of the relief valve assembly.

FIG. 6 is an end view of the relief valve assembly taken substantially on the lines 6—6 as shown in FIG. 5.

Referring to the drawings, the backflow prevention device generally designated 10 is positioned between two conventional gate valves 11 and 12. The gate valve 11 forms a part of a water supply pipe, and the gate valve 12 forms a part of a water discharge pipe. The device 10 prevents flow of water from the discharge pipe back into the supply pipe.

As shown in FIG. 2, the device 10 includes an upstream check valve assembly generally designated 13, a downstream check valve assembly generally designated 14 having a zone 15 between them. A relief valve assembly generally designated 16 vents the zone 15 to atmosphere whenever the pressure in the aspirated second chamber 53 approaches the pressure in the inlet passage 17, within predetermined limits. The passages 17 and 18 and the zone 15 are all formed within the integral body 19. The upstream check valve assembly 13 and the downstream check valve assembly 14 are mounted in the body 19 at right angles to each other, and each is positioned at an angle of 45 degrees to the aligned axes of the inlet and outlet passages 17 and 18.

The upstream check valve assembly 13 includes a stationary barrel 21 mounted within the body 19 and having a flange 33 clamped between the body 19 and the stationary cover 23. An alignment pin 20 assures the proper orientation of the barrel 21 within the body 19. One end of the barrel 21 has a circular opening 24 defined within a stationary annular seat 25. The barrel 21 has a side window 26 communicating with the zone 15.

A valve poppet 28 is slidably mounted in the barrel 21 for movement toward and away from the stationary seat 25. The valve poppet 28 is provided with an annular resilient disk 29 which cooperates with the seat 25 to form a bubble tight seal. A retainer plate 31 holds the resilient disk in position and is itself fixed to the valve poppet 28 by means of the screw 32. A coil compression spring 33 has one end seated against the internal shoulder 34 of the valve poppet 28 and the other end engaging an end flange 35 on the spring retainer 36. The spring 33 encircles the tapering portion **36*a* of the retainer. A key 37 presents turning of the retainer within the cover 23, whith cover is secured to the body 13 by means of threaded fastenings 38, as shown in FIG. 1. A central non-circular tubular stem 39 is secured to the valve poppet 28 by means of the threaded element 41 and washer 42, and slides through a notched non-circular opening 43 in the radial portion 36*b* of the spring retainer 36. The stem 39 is received into a matching recess 40 in the valve poppet 28. The valve poppet 28, stem 39, element 41, washer 42, retainer 36 and spring 33 constitute a unitary assembly for installation into position, in the absence of the cover 23. For safety reasons a special tool is required to engage the threaded element 41. The assembly of cover 23 to the body 13 causes the spring 33** to be further compressed beyond its relaxed position.

An ejector nozzle 44 is mounted on the valve poppet 28 and has a relatively large entrance opening 45 communicating with the first chamber 46 defined between the valve poppet 28 and the barrel 21 and beween the ribs 47 and 48. The discharge opening 49 is smaller and is directed toward a transverse passae 51 in the valve poppet 28 but which is separated therefrom by the space 52. The space 52 communicates with a reduced pressure second chamber 53 containing the spring 33. This second chamber 53 extends into the upper portion of the barrel 21 and into the cover 23 both inside and outside of the spring retainer 36.

A circumferential groove 54 is formed in the outer cylindrical surface of the valve poppet 28, and this groove 54 is interrupted at two locations to communicate with the arcuate spaces 55 and 56 formed in the outer surface of the valve poppet 28 and bounded by the interior surface 57 of the stationary barrel 21. The arcuate space 55 extends from the rib 48 to the rib 58, and the arcuate space 56 extends from the rib 47 to the rib 59. Both of these arcuate spaces 55 and 56 communicate with the window opening 26 in the barrel 21. As best shown in FIG. 4, the transverse passage 51 in the valve poppet 28 discharges through the center of the window opening 26 in the stationary barrel 21 into the zone 15.

The downstream check valve assembly 14 is similar to the upstream check valve assembly 13 in many respects except that it does not have an ejector nozzle 44 or a transverse passage 51. The stationary barrel 61 carries the stationary annular seat 62 which is engaged by the resilient disk 63 carried on the valve poppet 64. The coil compression spring 65 engages the cover 66 at one end and engages the valve poppet 64 at the other end. The cover 66 and the barrel 61 are secured to the body and aligned in the manner described in connection with the upstream check valve assembly 13.

The relief valve assembly 16 is best shown in FIGS. 5 and 6 and it includes a stationary housing 67 and a valve member 68 in the housing movable toward and away from a stationary annular seat 69. The resilient disk 71 is carried on the valve member for contact with the annular seat 69. The valve member 68 includes a valve stem 72 slidably mounted in the guide 73 and having the circular plate 74 fixed on one end by means of the threaded stem element 75 and washer 75*a*. The cover 76 is bolted to the housing 67 and clamps the rim of a relatively large rolling diaphragm 77 between them. The relatively small rolling diaphragm 78 has its outer periphery clamped between the guide 73 and a wall of the housing 67. The inner portion of the rolling diaphragm 78 is fixed to the valve member 68 by means of the clamping plate 79 and threaded fastenings 81. The effect of the diaphragm 78 is to offset the unbalanced forces resulting from the pressure differential between zone 15 and atmosphere pressure in discharge 104. A chamber 82 is formed within the housing 67 and between the flexible diaphragms 77 and 78, and this chamber 82 communicates with a terminal fitting 83. A similar terminal fitting 84 is carried on the cover 76 and communicates with the chamber 85 between the cover 76 and the flexible diaphragm 77.

The coil compression spring 86 has one end seated on the stationary guide member 73 and the other end contacts the pressure plate 87 mounted for self-aligning movement on the spherical surface of the central boss 88 on the plate 74. The tubular flanged part 89 is bolted to the housing 67 at 91 and is bolted to the mating flanged part 92 on the body 19, as shown in FIG. 1.

From this description it will be understood that pressure in the chamber 85 acts to close the valve disk 71 against the stationary seat 69, in opposition to the force of the spring 86. Pressure in the chamber 82 serves to supplement the force of the spring 86. Movement of the valve member 68 is guided by the sliding contact between the stem 72 and the guide 73 and by the sliding of the fingers 93 in the axial bore 94 of the member having the stationary seat 69. The guide fingers 93 are formed integrally with the circular plate 95 which holds the resilient disk 71 in place on the valve member 68.

Means are provided for subjecting the relief valve chamber 85 to pressure in the inlet passage 17 and, as shown in the drawings, this means includes the velocity sensitive pressure pickup tube 96 extending through the body 19 and connected to the terminal fitting 97. A pipe 98 connects the terminal fitting 97 to the terminal fitting 84 of the relief valve assembly 16. Additional means are provided for connecting the aspirated second chamber 53 in the upstream check valve assembly 13 to the space 82 in the relief valve housing 67 between the flexible diaphragms 77 and 78. As shown in the drawings, this means includes the terminal fitting 99 which communicates with the chamber 53, and the terminal fitting 83 which communicates with the relief valve space 82. A pipe 101 connects the terminal fitting 99 to the terminal fitting 93, as shown in FIG. 1. Conventional test fittings 102 and 103 are provided on the body 19 in communication with the inlet passage 17 and the outlet passage 18. These test fittings are normally closed.

In the operation of the backflow prevention device, the pressure of water in the upstream gate valve 11 acts through the inlet passage 17 and against the exposed portion of the upstream check valve assembly 13 within the annular stationary seat 25. This pressure tends to open the valve in opposition to the force of the spring 33. When the upstream pressure has reached a sufficient intensity to move the valve disk 29 away from the seat 25, the pressure acts over a larger cross sectional area of the valve poppet 28 and the additional force increases the opening movement of the valve disk 29 away from the stationary seat 25. Water flows into the arcuate space or first chamber 46 between the shoulders 47 and 48 and passes through the ejector nozzle 44 and into the flared entrance opening 50 of the transverse passage 51. The rapid flow from the small discharge end of the ejector nozzle 44 reduces the pressure of liquid in the chamber 53 by an aspiration effect. Water is discharged from the transverse passage 51 through the third chamber or zone 15 and its velocity head acts directly on the exposed surface of the valve poppet 64 in the downstream check valve assembly 14. Water is discharged through the window 60 in the wall of the barrel 61 and passes into the discharge passage 18 in the body 19.

The configuration of the ribs and spaces on the outer surface of the valve poppet 28 in the upstream check valve assembly 13 has the following beneficial effect: The flow from the inlet passage 17 is shielded from any substantial communication directly with the zone 15, and instead the flow from the inlet passage 17 is directed toward the arcuate space or first chamber 46 which is defined between the inclined ribs 47 and 48 and which space 46 feeds the ejector nozzle 44. The spaces or pockets 55 and 56 on the other side of these barrel-contacting ribs 47 and 48 are in direct open communication with the side window 26 in the stationary barrel 21, and hence are in communication with the third chamber or zone 15. The circumferential cross flow on the periphery of the valve poppet 28 through the groove 54, pockets 55 and 56 and side window 26 serves as a barrier to leakage from the inlet 17 axially along the cylindrical surface of the valve poppet 28 into the aspirated second chamber 53.

Check valve 13 is designed to maintain a specified minimum pressure differential and cooperates with the relief valve assembly 16 to insure that no reverse flow could ever occur. If for any reason the pressure differential reflected to the assembly falls below a prescribed level, the relief valve assembly opens to vent the zone 15 to atmosphere as a means of maintaining this required differential. The second check valve 14 normally also maintains a lesser pressure differential; however, it is subject to system pressure conditions wherein the pressure in discharge chamber 18 can exceed the normal supply pressure in chamber 17. Under these conditions the function of check valve 14 is to remain closed and isolate zone 15 from the higher backflow pressure. If the second check valve 14 should leak, this reverse flow would tend to equalize the pressure differential maintained across the first check valve 13 and consequently the relief valve assembly 16 would be caused to open and vent the zone 15 to atmosphere and dissipate the reverse flow leakage.

More particularly, if the differential pressure between the chamber 85 and the chamber 82 is not maintained, the spring 86 acts in a direction to open the valve by moving the disk 71 away from the stationary seat 69. This pressure differential could be reduced by reason of leakage through the downstream check valve 14, or it might be reduced by failure to maintain the pressure drop through the upstream check valve 13. Any factor or foreign matter which could cause leakage through the upstream check valve 13 would tend to diminish the pressure differential between the chambers 82 and 85.

Check valve 13 functions to maintain a high initial pressure differential as a backflow protection margin of safety, and to resist initial flow through the check valve. However, as normal flow is established and increases, the initial pressure differential across its seat is reflected against the larger area of the valve poppet 28 and is applied across the ejector 44 which in turn aspirates the chamber 53. This combined effect causes the check valve 13 to provide a substantially reduce pressure differential under flowing conditions. This substantially reduced pressure differential is actually less than the initial pressure differential required under a no flow condition. In order to prevent this lower than normal pressure differential from causing the differential relief valve to open, a higher pressure differential is reflected to the relief valve assembly 16 as a result of adding the velocity head pressure sensed through tube 96 to pressure chamber 85 and by also applying the reduced pressure in the aspirated chamber 53 to pressure chamber 82. The result is that the differential reflected to the control is greater than the differential between pressure chamber 17 and zone 15 but it is only greater under velocity flowing conditions. Under static or reverse flow conditions wherein the relief valve assembly may be required to open, unwanted pressure differentials related to normal flow conditions are not induced.

The device shown in the drawings and described above has been found to have exceptional operating characteristics. The pressure required for initial opening of the upstream check valve 13 is relatively high, and yet the pressure drop from the inlet passage 17 to the outlet passage 18 is exceptionally low during normal flow conditions.

Having fully described my invention, it is to be understood that I am not to be limited to the details herein set forth but that my invention is of the full scope of the appended claims.

I claim:

1. In backflow prevention apparatus for installation between a supply pipe and a discharge pipe, the apparatus including a differential check valve assembly for connection to the supply pipe, the improvement comprising, in combination: a stationary valve seat, a stationary barrel positioned coaxially of said valve seat, a valve poppet guided for movemnt in said barrel toward and away from said valve seat, a spring acting to move said valve poppet into sealing contact with said valve seat, means cooperating with said barrel and said valve poppet to define a chamber remote from said valve seat, an ejector nozzle on said valve poppet receiving fluid from said barrel when said valve poppet has separated from said valve seat, the outer surface of the valve poppet having pockets and ribs cooperating with said barrel to produce circumferential flow of fluid on the outer surface of said valve poppet away from said ejector nozzle and thereby acting to minimize axial flow from said valve seat along said valve poppet into said chamber, said ejector nozzle having a portion communicating with said chamber so that relatively rapid fluid flow from said ejector nozzle causes a reduction in fluid pressure in said chamber to oppose the action of said spring.

2. In a check valve assembly, the improvement comrising, in combination: a stationary valve seat, a stationary barrel positioned coaxially of said valve seat, a removable cover secured relative to said barrel, a valve poppet guided for movement in said barrel toward and away from said valve seat, a spring acting to move said valve poppet into sealing contact with said valve seat, means cooperating with said barrel and said cover and said valve poppet to define a spring chamber remote from said valve seat and enclosing said spring, said valve poppet having a central axial stem fixed thereto, a spring retainer positioned within a portion of said spring and having a central opening for sliding contact with said stem, said valve poppet, stem, spring and retainer being axially insertable into said barrel as a unitary assembly in the absence of said removable cover, aspirator means receiving fluid from said barrel when said valve poppet has separated from said valve seat, said aspirator means communicating with said spring chamber so that relaively rapid fluid flow through said aspirator means causes a reduction in fluid pressure in said spring chamber to oppose the action of said spring and thereby reduce the pressure drop across the check valve assembly.

3. In a check valve assembly, the improvement comprising, in combination: a stationary body, a stationary barrel positioned within the body and having a coaxial valve seat thereon, a removable cover secured relative to said barrel and body, a valve poppet guided for movement in said barrel toward and away from said valve seat, a spring acting to move said valve poppet into sealing contact with said valve seat, means cooperating with said barrel and said cover and said valve poppet to define a spring chamber remote from said valve seat and enclosing said spring, said valve poppet having a central axial stem fixed thereto, a spring retainer positioned within a portion of said spring and having a central opening for sliding contact with said stem, said valve poppet, stem, spring, retainer, barrel and seat being axially insertable into said body as a unitary assembly in the absence of said removable cover, aspirator means receiving fluid from said barrel when said valve poppet has separated from said valve seat, said aspirator means communicating with said spring chamber so that relatively rapid flow through said aspirator means causes a reduction in fluid pressure in said spring chamber to oppose the action of said spring and thereby reduce the pressure drop across the check valve assembly.

* * * * *